US006112811A

United States Patent [19]

Kilgore et al.

[11] Patent Number: 6,112,811

[45] Date of Patent: Sep. 5, 2000

[54] SERVICE PACKER WITH SPACED APART DUAL-SLIPS

[75] Inventors: Marion D. Kilgore, Dallas; Robert L. Hilts, Carrollton, both of Tex.

[73] Assignee: Halliburton Energy Services, Inc., Dallas, Tex.

[21] Appl. No.: 09/004,394

[22] Filed: Jan. 8, 1998

[51] Int. Cl.[7] ..... E21B 23/06; E21B 33/12

[52] U.S. Cl. ..... 166/134; 166/120; 166/212

[58] Field of Search ..... 166/120, 134, 166/212, 387, 382, 118, 191; 175/423

[56] References Cited

U.S. PATENT DOCUMENTS

| | | | |
|---|---|---|---|
| 3,559,733 | 2/1971 | Kilgore | 166/134 |
| 4,457,369 | 7/1984 | Henderson | 166/125 |
| 4,600,058 | 7/1986 | Wormer et al. | 166/382 |
| 5,046,557 | 9/1991 | Manderscheid | 166/120 |
| 5,433,269 | 7/1995 | Hendrickson | 166/134 |
| 5,875,852 | 3/1999 | Floyd et al. | 166/387 |
| 5,988,276 | 11/1999 | Oneal | 166/134 X |

*Primary Examiner*—Eileen D. Lillis
*Assistant Examiner*—Sunil Singh
*Attorney, Agent, or Firm*—Paul I. Herman; Marlin R. Smith

[57] ABSTRACT

Apparatus and methods are provided for anchoring within tubular structures and releasing therefrom. A packer capable of withstanding very large combined loads and differential pressures is provided with multiple dual slips. The packer uniquely distributes forces resulting from the loads and differential pressures among its slips, thereby minimizing damage to the tubular structure. In addition, the packer includes a debris barrier and a release device which permit convenient retrieval of the packer.

24 Claims, 9 Drawing Sheets

SERVICE PACKER WITH SPACED APART DUAL-SLIPS

BACKGROUND OF THE INVENTION

The present invention relates generally to anchoring apparatus utilized in subterranean wells and, in an embodiment described herein, more particularly provides a packer for use in extreme service conditions.

In a typical packer having a single slip, which may consist of a single slip member or multiple circumferentially distributed slip segments, forces applied to the packer are necessarily resisted by the same slip. Thus, when a downwardly directed tubing load and a downwardly directed differential pressure are applied to the packer, the single slip must resist both by its gripping engagement with a tubular structure (such as casing, tubing, other equipment, etc.) in which it is set. In extreme service conditions, the slip may need to be radially outwardly forced into contact with the tubular structure, in order to resist the forces applied to the packer, with enough force to cause damage to the tubular structure, the packer, or both.

If the gripping surface area on the slip is increased in an attempt to increase the gripping engagement between the slip and the tubular structure, it has been found that it is more difficult for the slip to initially bite into the tubular structure. This is due to the fact that more of the slip is required to deform more of the tubular structure. Consequently, more radially outwardly directed force must be applied to the slip, thereby causing damage to the tubular structure.

It would be advantageous to be able to use multiple axially spaced apart slips on an anchoring device, in order to distribute forces applied to the device among the slips. In addition, it would be advantageous for each of the multiple slips to be dual slips, so that each of the slips could resist forces applied thereto in both axial directions. Unfortunately, the use of multiple axially spaced apart slips presents additional problems, particularly when the slips are dual slips.

For example, it may be difficult to retrieve the anchoring device after the slips have been grippingly engaged with the tubular structure. This is due to the fact that slips generally have inclined teeth, serrations, etc. formed thereon which, when axially opposed with other slips, resist disengagement from the tubular structure.

As another example, mechanisms to extend and then retract multiple slips may be prohibitively complex, and therefore unreliable, uneconomical and/or too delicate for use in extreme service conditions. Thus, an extreme service anchoring apparatus utilizing multiple axially spaced apart slips should include appropriately robust, economical and reliable mechanisms for extending the slips and, where the apparatus is to be made retrievable, should include a retracting mechanism with similar qualities.

From the foregoing, it can be seen that it would be quite desirable to provide an anchoring apparatus which minimizes damage to a tubular structure in which it is set. The apparatus would make advantageous use of multiple slips and include an appropriate mechanism for extending the slips and, where the apparatus is to be retrievable, include an appropriate mechanism for retracting the slips. It is accordingly an object of the present invention to provide such apparatus and associated methods of anchoring and releasing the apparatus within the tubular structure.

SUMMARY OF THE INVENTION

In carrying out the principles of the present invention, in accordance with an embodiment thereof, a hydraulically set packer is provided which uses multiple axially spaced apart dual slips and uniquely distributes forces applied to the packer among the slips. The packer is reliable, retrievable, economical and convenient in operation. Associated methods are also provided.

In broad terms, apparatus is provided which includes multiple dual slips disposed relative to a generally tubular mandrel. Each of the dual slips has a portion thereof which resists loads applied directly to the mandrel, and a portion thereof which resists pressure differentials applied to a seal assembly carried on the mandrel. When these forces are combined and acting on the apparatus in the same axial direction, one of the slips resists the load applied to the mandrel, and the other slip resists the pressure differential applied to the packer via the tubing to casing seal assembly.

In another aspect of the present invention, a radially extendable debris barrier is provided on the apparatus and disposed above the upper slip. The debris barrier is positioned on a laterally inclined outer side surface of a wedge associated with the upper slip. When the upper slip is radially outwardly extended by the wedge, axial displacement of the slip relative to the wedge causes the debris barrier to radially outwardly extend as well. The debris barrier closes off an annular gap between the wedge and the tubular structure in which the apparatus is set, thereby excluding debris from accumulating about the apparatus and enhancing retrieval of the apparatus.

In yet another aspect of the present invention, the apparatus is provided with a release device for releasing a compressive force from the seal assembly. In this manner, the slips may be more readily disengaged from the tubular structure in which the apparatus has been set. The release device permits the seal assembly to axially elongate between the slips, thereby releasing a tensile force applied to the tubular structure between the slips.

The exemplary embodiment of the invention described below is a packer specifically designed for use in extreme service conditions. However, the principles of the present invention may be readily utilized in other equipment, such as plugs, hangers, etc.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1A:
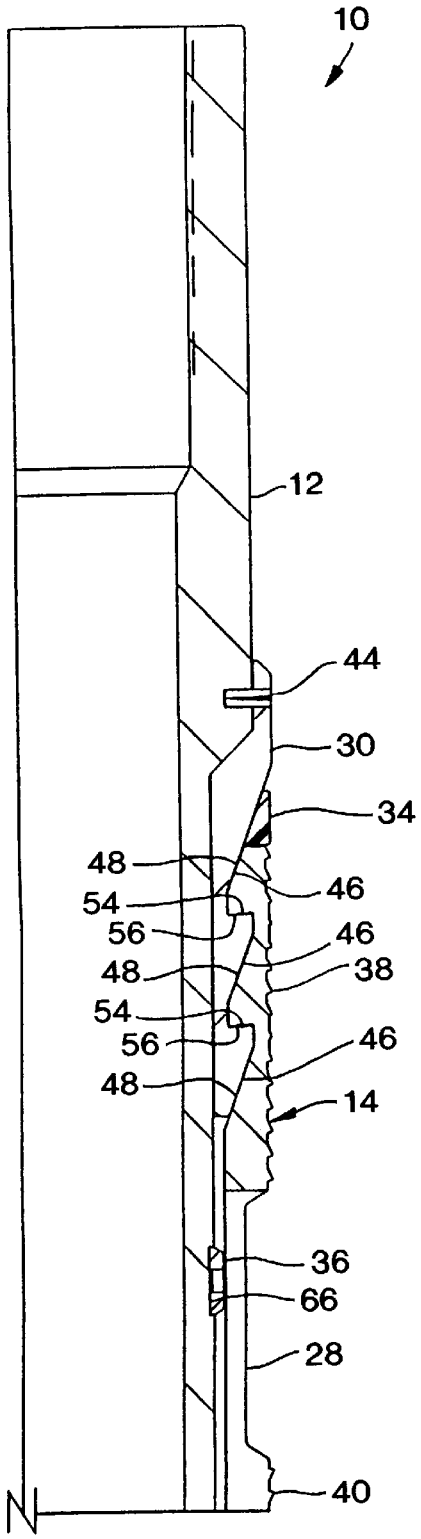
FIGS. 1A–1F are quarter-sectional views of successive axial sections of an apparatus embodying principles of the present invention, the apparatus being shown in a configuration in which it is run into a subterranean well.

Representatively illustrated in FIGS. 1A–1F is a packer 10 which embodies principles of the present invention. In the following description of the packer 10 and methods described herein, directional terms, such as "above", "below", "upper", "lower", etc., are used for convenience in referring to the accompanying drawings. Additionally, it is to be understood that the embodiment of the present invention described herein may be utilized in various orientations, such as inclined, inverted, horizontal, vertical, etc., without departing from the principles of the present invention.

The packer 10 includes an inner generally tubular mandrel 12, which is internally threaded at its upper end for attachment to a tubular string (not shown in FIGS. 1A–1F) in a conventional manner. Loads may be transmitted to the mandrel 12 from the tubular string in each axial direction. For example, an axially downwardly directed load may be applied to the mandrel 12 by the weight of the tubular string. An axially upwardly directed load may be applied to the mandrel 12 by axial contraction of the tubular string, such as when relatively cool injection fluids are pumped through the tubular string. Many other situations may also result in loads being applied to the mandrel 12.

For resisting these loads and other forces applied to the packer 10, the packer includes an upper slip assembly 14 and a lower slip assembly 16. The packer 10 also includes a seal assembly 18, an axially collapsible assembly or release device 20, a hydraulic setting assembly 22, an internal slip assembly 24, and a retrieval mechanism 26.

The upper slip assembly 14 includes a dual barrel slip 28, an upper wedge 30, a lower wedge 32, a debris barrier 34, and a generally C-shaped snap ring 36 disposed in an annular recess 66 formed on the mandrel 12. The slip 28 is of the dual type, meaning that it is configured for resisting forces applied thereto in both axial directions. For this purpose, teeth or other gripping structures 38 on the slip 28 are oppositely oriented relative to other teeth or other gripping structures 40 on the slip. In the representatively illustrated slip 28, the teeth 38, 40 are formed directly on the slip, which is a circumferentially continuous axially slotted barrel slip of the type well known to those of ordinary skill in the art. The lower slip assembly 16 includes a similar slip 42. However, it is to be clearly understood that the slips 28, 42, or either of them, may be differently configured without departing from the principles of the present invention. For example, the teeth 38, 40 or other gripping structures may be separately attached to the remainder of the slip, the slips 28, 42 may be C-shaped, or otherwise circumferentially discontinuous, the slips may be circumferentially divided into slip segments, etc.

The upper wedge 30 is releasably secured to the mandrel 12 with a pin 44 installed through the wedge and into the mandrel. Multiple generally conical downwardly facing outer side surfaces 46 formed on the wedge 30 engage complementarily shaped inner side surfaces 48 formed on the slip 28, so that when the slip is displaced axially upward relative to the wedge, in a manner described more fully below, the slip is radially outwardly displaced relative to the mandrel 12. The lower wedge 32 similarly has multiple generally conical upwardly facing outer side surfaces 50 formed thereon, and the slip 28 has complementarily shaped inner side surfaces 52 formed thereon, for radially outwardly displacing the slip. Additionally, the wedges 30, 32 and slip 28 have inclined surfaces 54, 56 formed thereon, respectively, to prevent axial separation therebetween, and to aid in radially inwardly retracting the slips when the packer 10 is retrieved, as described more fully below.

The lower slip assembly 16 is generally similar to the upper slip assembly 14. The lower slip assembly 16 includes the slip 42, an upper wedge 58 releasably secured against displacement relative to the mandrel 12 by a pin 60, a lower wedge 62, and a snap ring 64 disposed in an annular recess 68 formed on the mandrel 12. The slip 42 and wedges 58, 62 have the corresponding surfaces 46, 48, 50, 52, 54, 56 formed thereon, albeit oppositely oriented as compared to the upper slip assembly 14.

The seal assembly 18 includes multiple circumferential seal elements 70 of conventional design carried about the mandrel 12. Of course, more or less of the seal elements 70 or differently configured seal elements may be utilized in a packer or other apparatus constructed in accordance with the principles of the present invention. The seal elements 70 are axially straddled by backup shoes 72. The seal elements 70 are radially outwardly extendable relative to the mandrel 12 by axially compressing them between an upper generally tubular element retainer 74 and a lower generally tubular element retainer 76.

The setting assembly 22 includes a lower portion of the lower element retainer 76 which carries internal seals 78 thereon for sealing engagement with the mandrel 12, and which carries external seals 80 thereon and is threadedly attached to an outer tubular housing 82. A difference in diameters between the seals 78, 80 forms an annular piston or differential piston area on the element retainer 76. Another annular piston 84 is sealingly engaged radially between the housing 82 and the mandrel 12, and is disposed axially between a snap ring 86 and an upper tubular portion of the wedge 58.

An opening 88 formed radially through the mandrel 12 permits fluid communication between the interior of the mandrel and an annular chamber 90 formed radially between the mandrel and the housing 82, and axially between the element retainer 76 and the annular piston 84. A predetermined fluid pressure differential is applied to the interior of the mandrel 12 (e.g., via the tubular string connected thereto and extending to the earth's surface) and thus to the chamber 90 to set the packer 10, as will be more fully described below.

The internal slip assembly 24 includes a slip member 92 disposed radially between the housing 82 and the upper tubular portion of the wedge 58. The slip member 92 is engaged with the housing 82 by means of relatively coarse teeth or buttress-type threads 94, and the slip member is engaged with the upper tubular portion of the wedge 58 by means of relatively fine teeth or buttress-type threads 96. The teeth or threads 94, 96 are inclined, so that the slip member 92 permits the wedge 58 to displace axially downward relative to the housing 82, but prevents axially upward displacement of the wedge 58 relative to the housing.

A shear screw 98 installed laterally through a generally tubular retainer 100 threadedly attached to the housing 82, and into a recess 102 formed externally on the wedge 58 releasably secures the housing against displacement relative to the wedge 58. A circumferential wave spring 104 compressed axially between the slip member 92 and the retainer 100 maintains an axially upwardly directed force on the slip member, so that the slip member is maintained in engagement with both the housing 82 and the wedge 58. A pin 106 is installed through the housing 82 and into an axial slot formed through the slip member 92, to prevent rotation of the slip member.

Figure 1B:
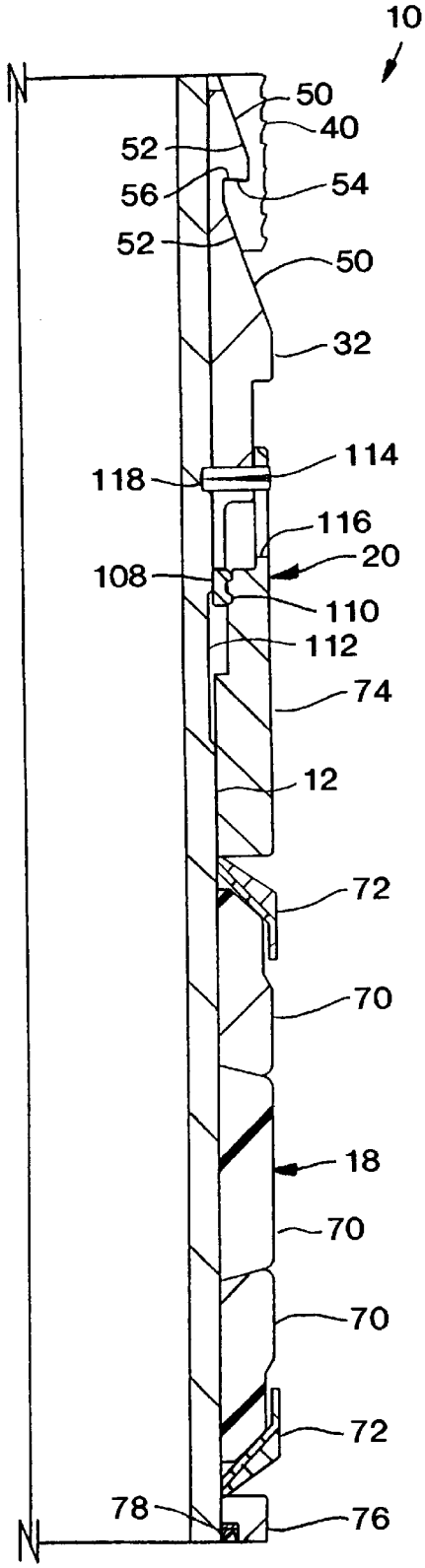
Figure 1C:
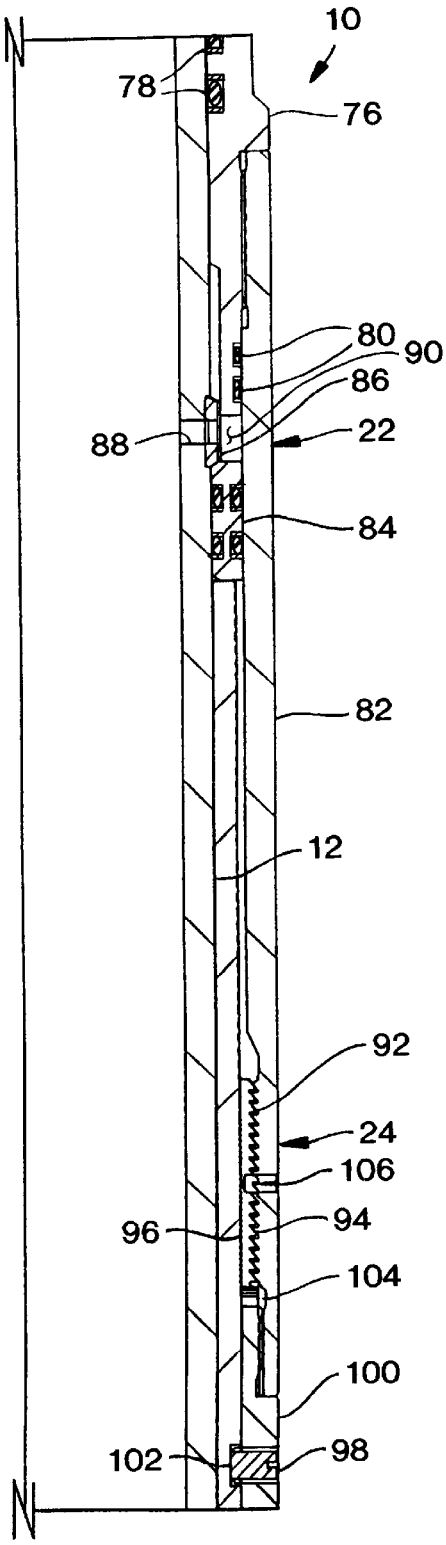
Figure 1D:
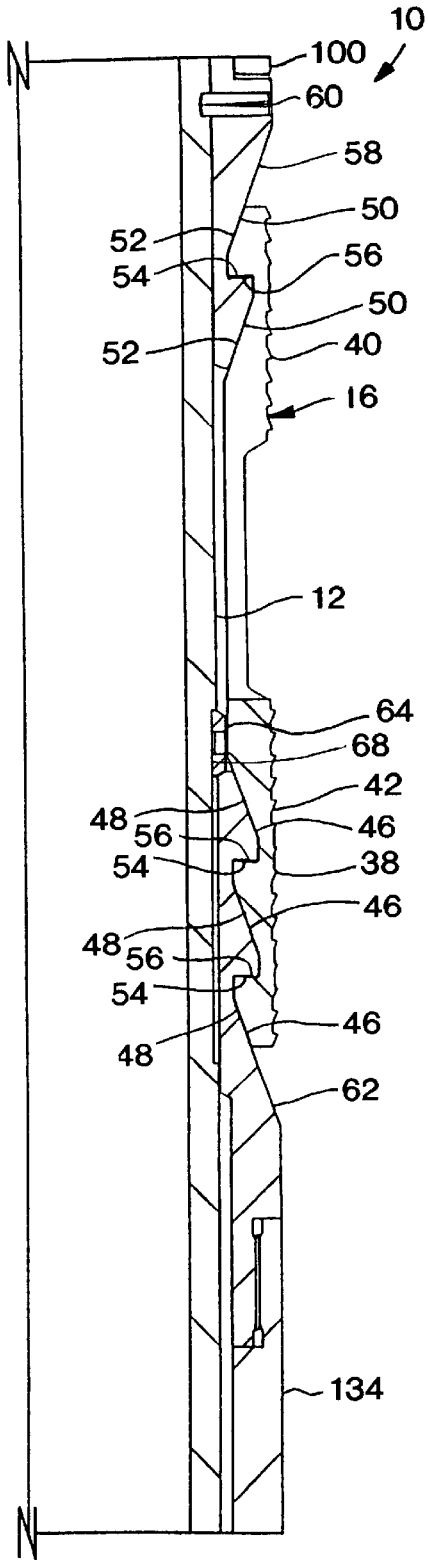
Figure 1E:
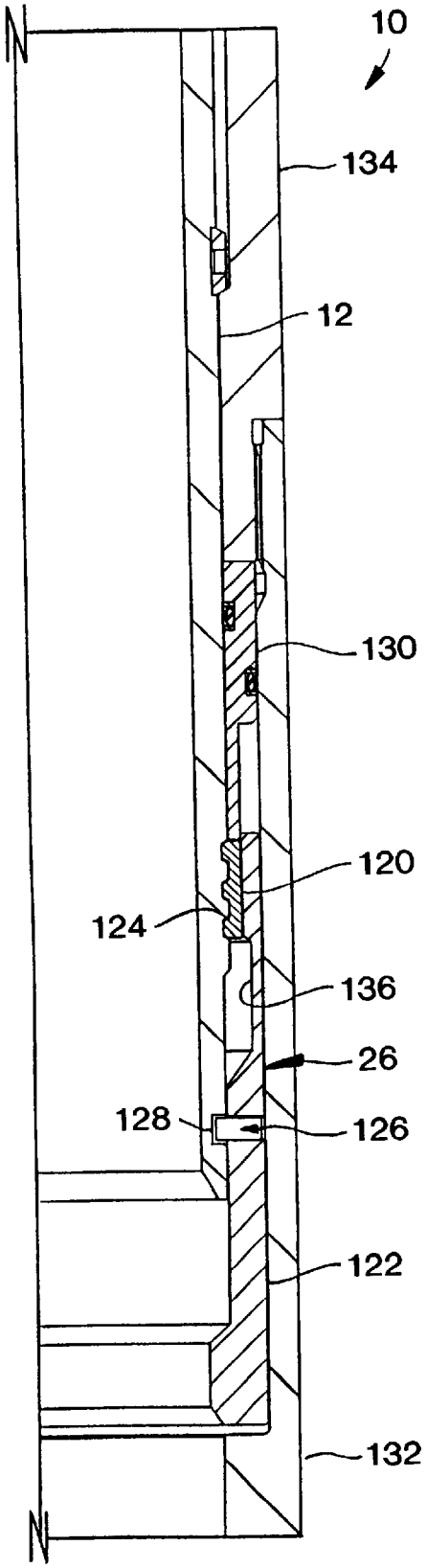
Figure 1F:
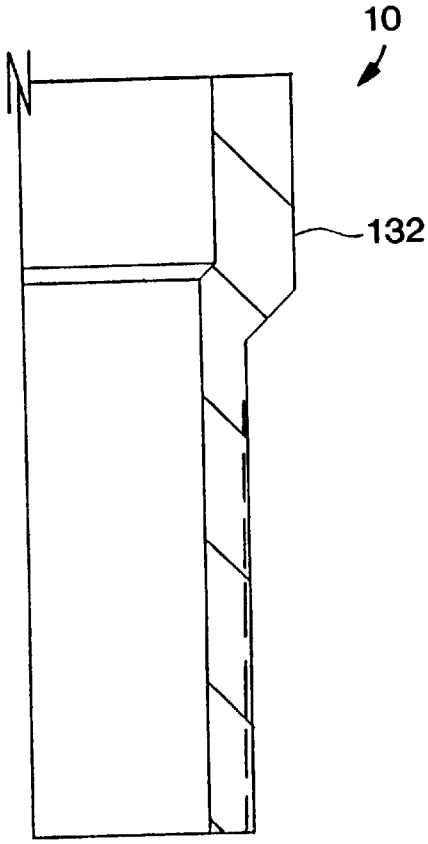
Figure 2A:
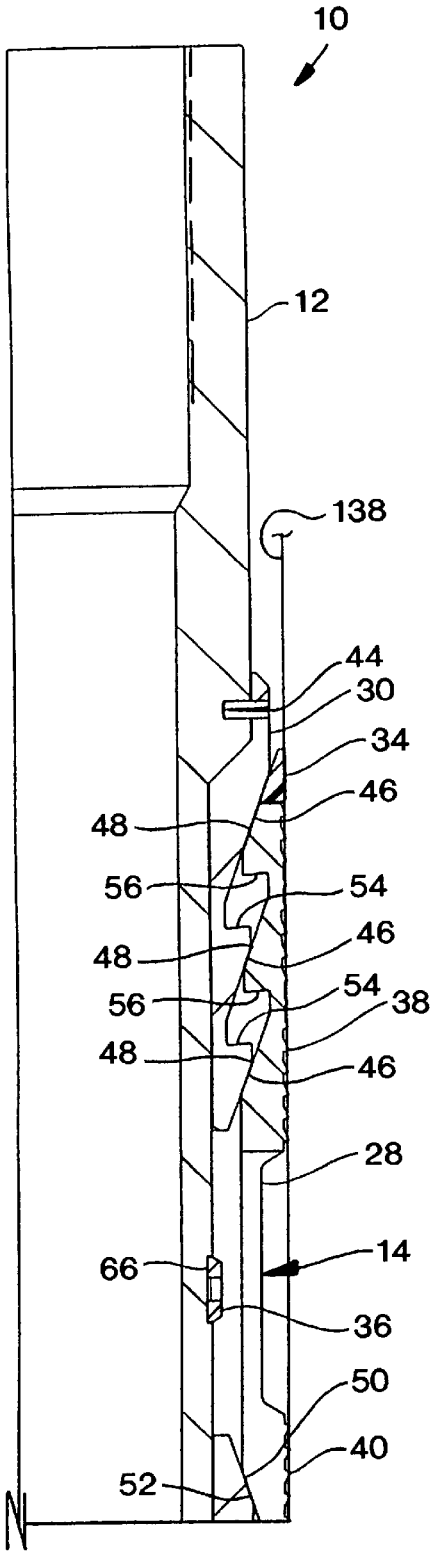
FIGS. 2A–2F are quarter-sectional views of successive axial sections of the apparatus of FIGS. 1A–1F, the apparatus being shown in a configuration in which it is set within a tubular structure in the well.
Figure 2B:
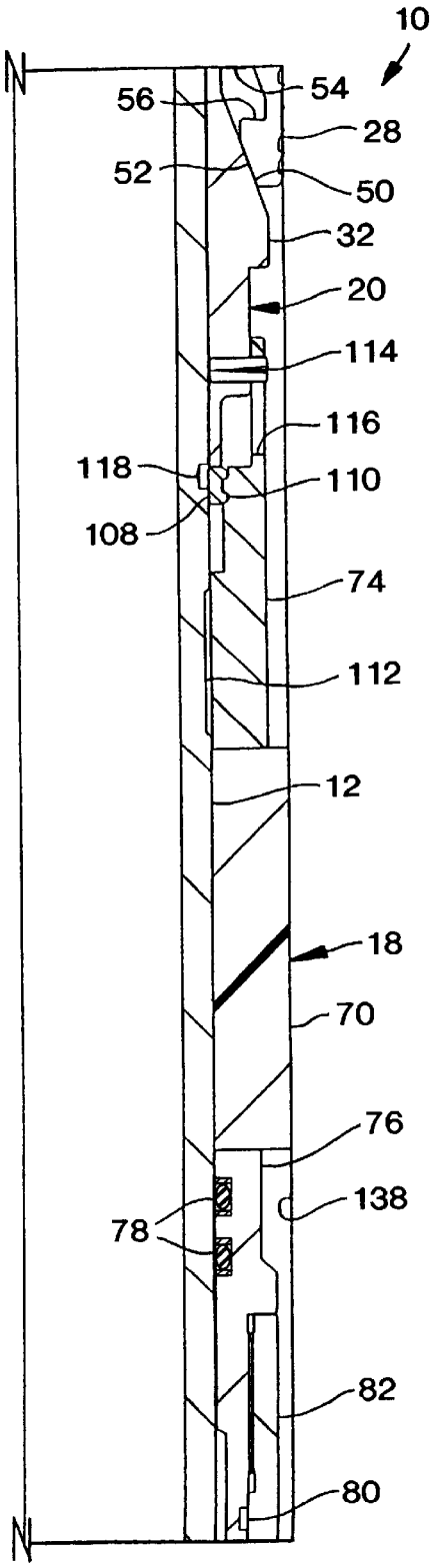
Figure 2C:
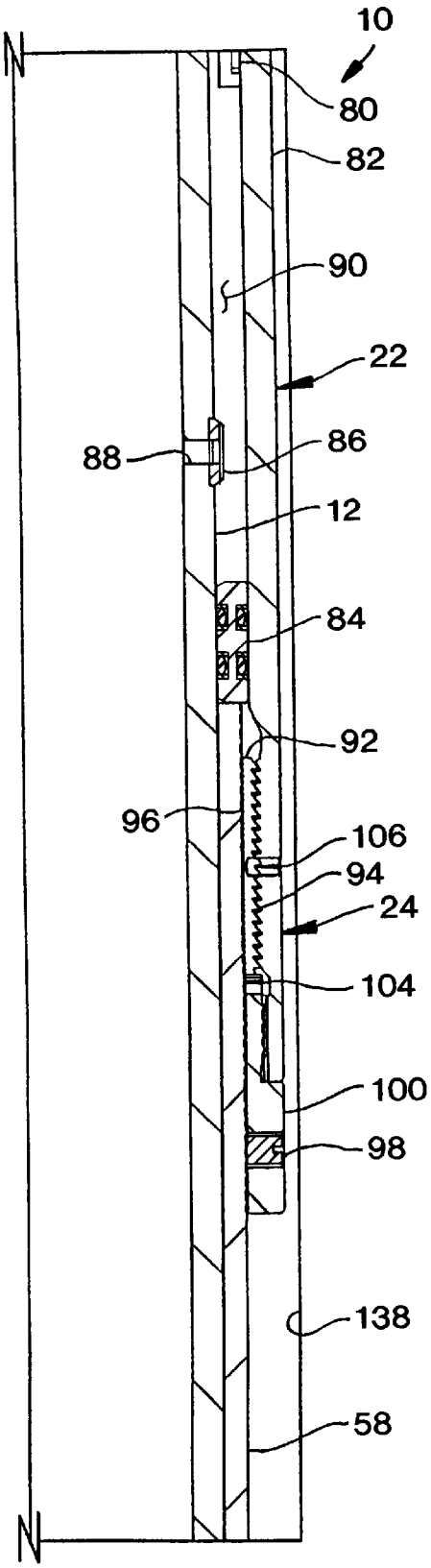
Figure 2D:
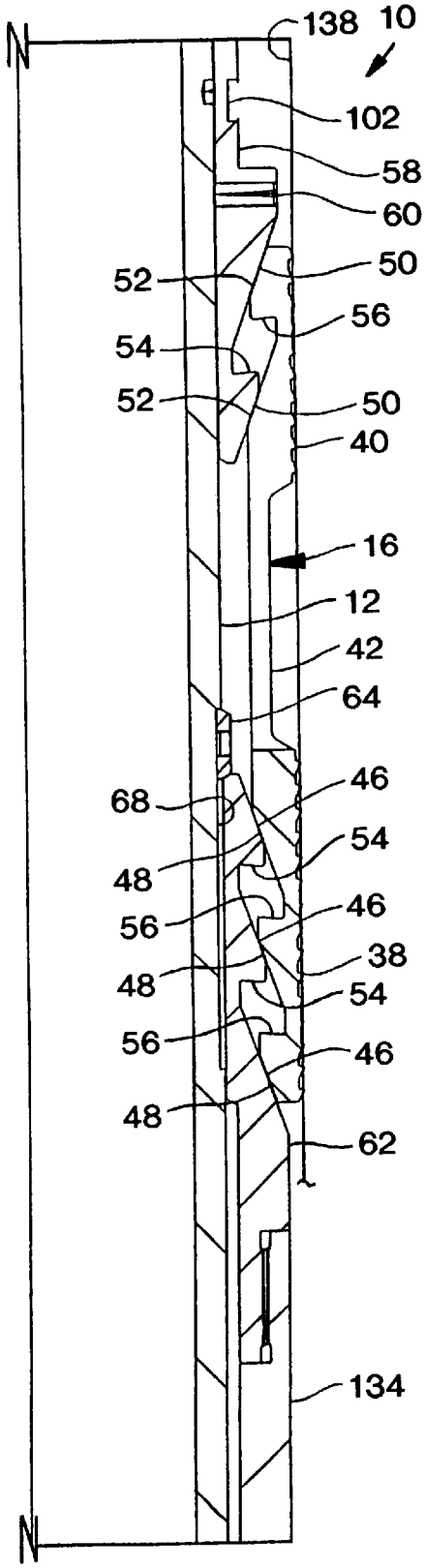
Figure 2E:
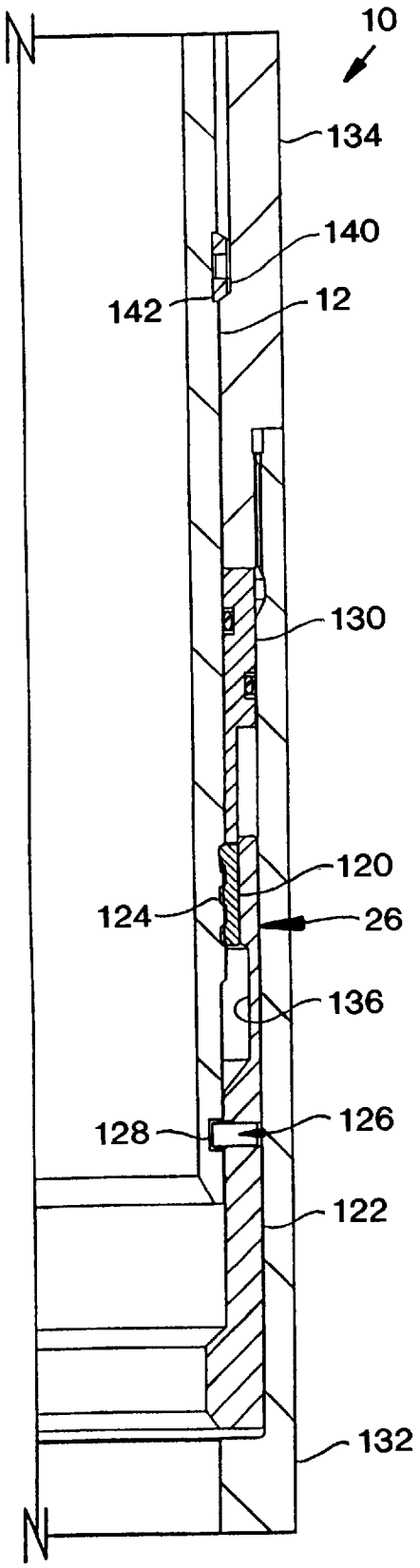
Figure 2F:
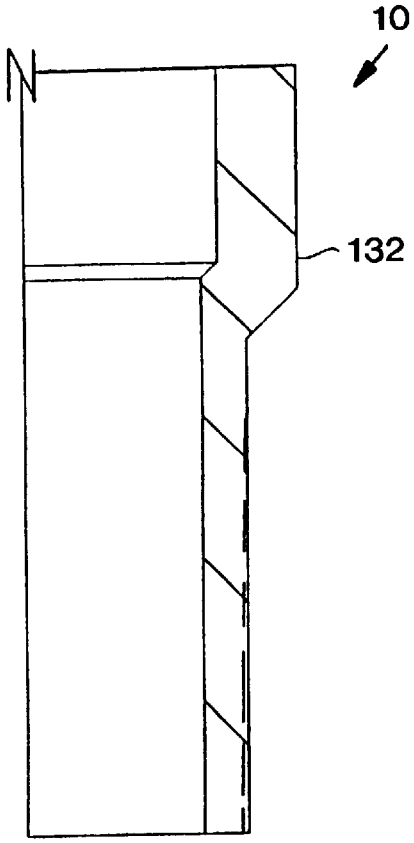
Figure 3A:
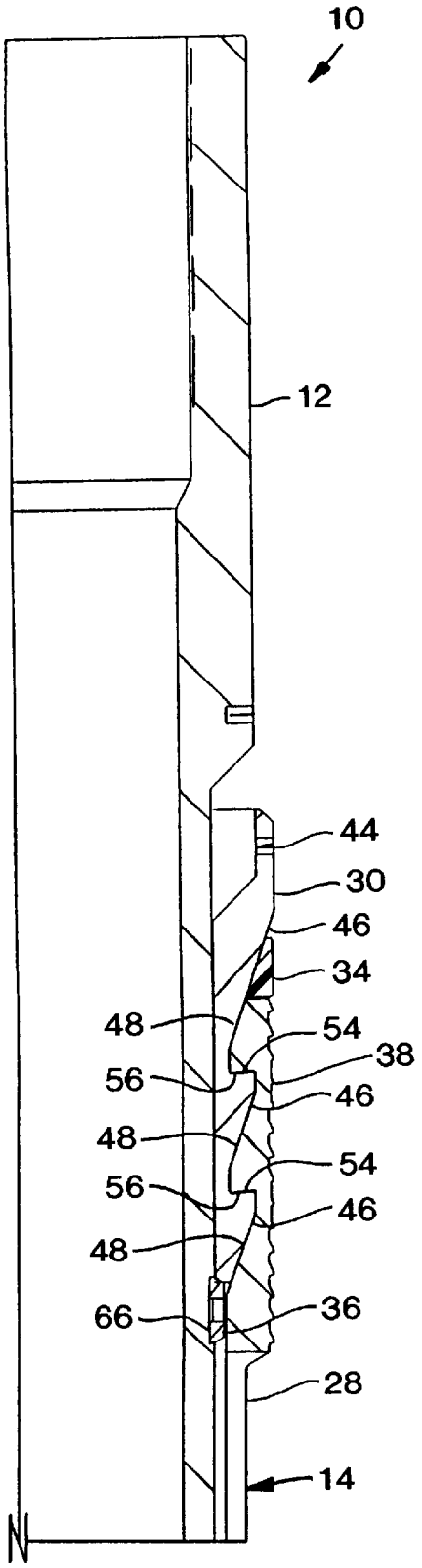
FIGS. 3A–3F are quarter-sectional views of successive axial sections of the apparatus of FIGS. 1A–1F, the apparatus being shown in a configuration in which it is retrieved from the well.
Figure 3B:
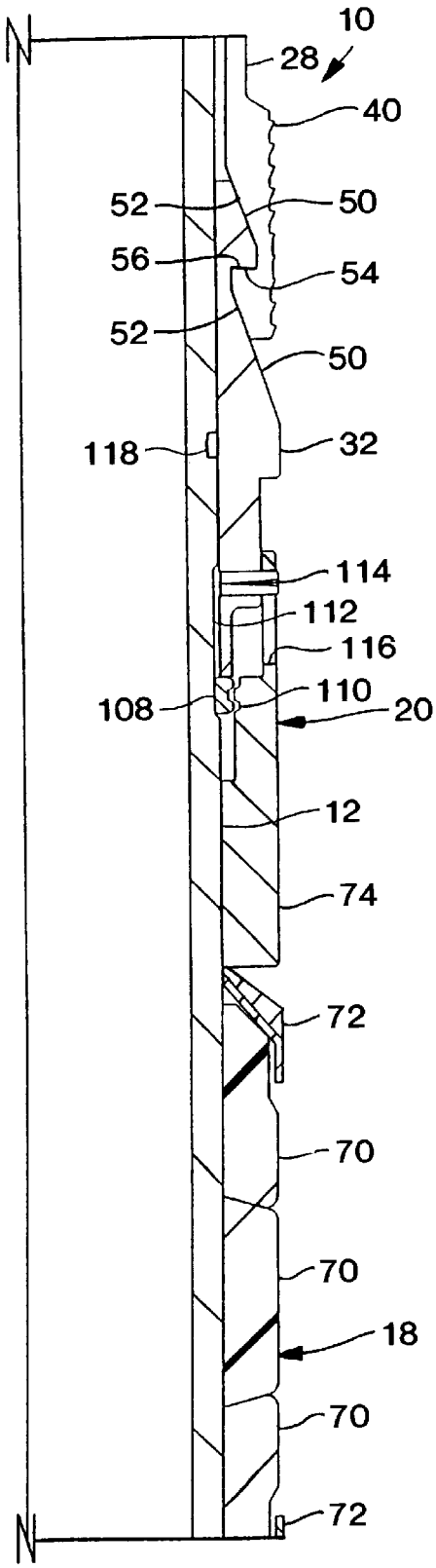
Figure 3C:
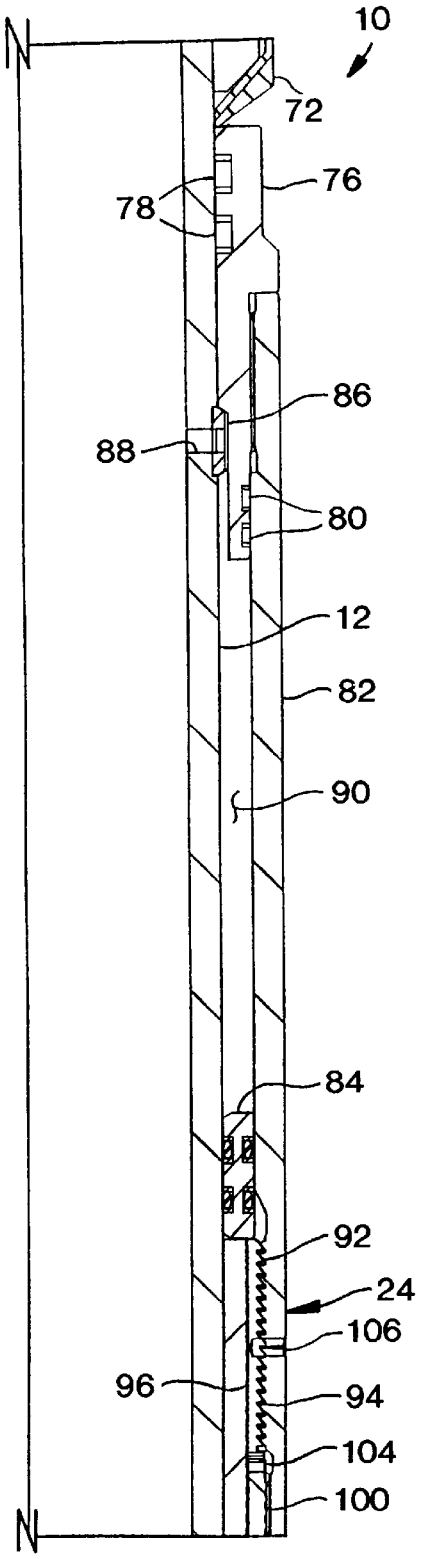
Figure 3D:
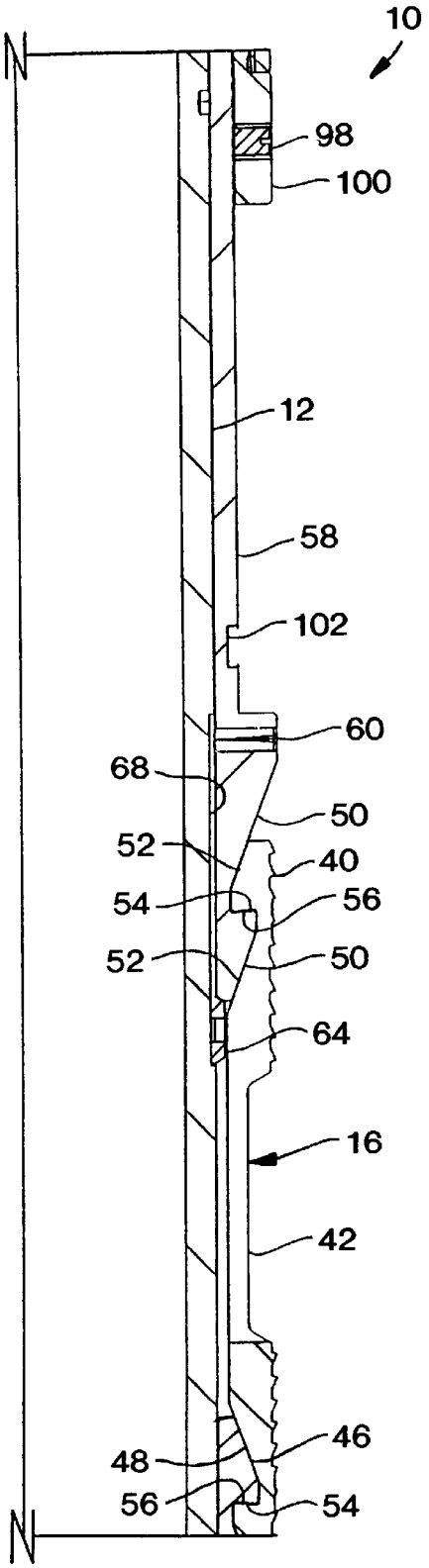
Figure 3E:
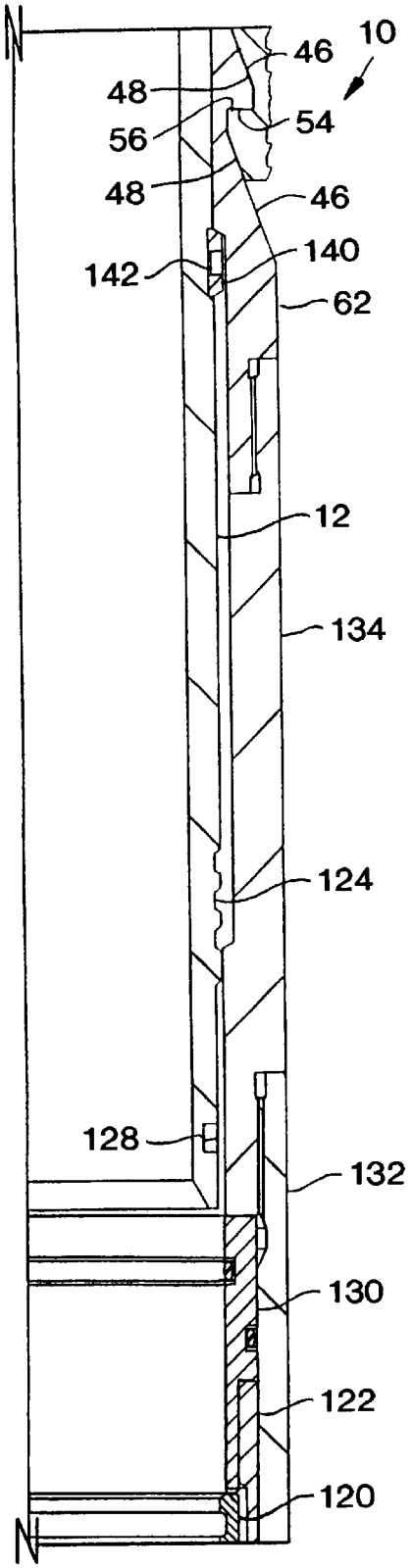
Figure 3F:
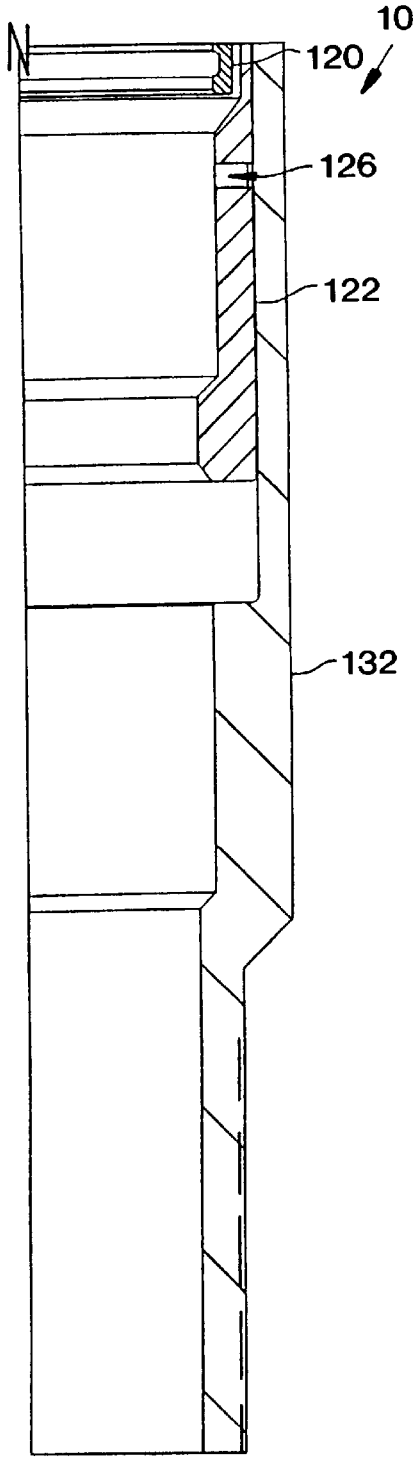

The release device 20 includes an upper portion of the element retainer 74, which is axially telescopingly engaged with a lower portion of the wedge 32. A generally C-shaped snap ring 108 engages a profile 110 formed internally on the element retainer 74, and abuts the lower end of the wedge 32. Thus, as shown in FIG. 1B, the ring 108 prevents axial compression of the release device 20. However, when the mandrel 12 is axially upwardly displaced relative to the ring 108, permitting the ring to radially inwardly retract into an annular recess 112 formed externally on the mandrel, the release device is permitted to axially compress, thereby relieving axial compression of the seal assembly 18 in a manner more fully described below.

A pin 114 is installed through an axially elongated slot 116 formed through the element retainer 74, through the wedge 32, and into a recess 118 formed on the mandrel 12. The pin 114 releasably secures the wedge 32 relative to the mandrel 12, and prevents axial separation of the element retainer 74 and wedge 32, while still permitting the wedge and element retainer to displace axially toward each other.

The retrieval mechanism 26 permits the packer 10 to be conveniently retrieved from the tubular structure in which it is set. It includes a generally C-shaped snap ring 120 disposed radially between the mandrel 12 and a generally tubular support sleeve 122. The support sleeve 122 maintains the ring 120 in engagement with a profile 124 formed externally on the mandrel 12. A pin 126 installed through the sleeve 122 and into a recess 128 formed externally on the mandrel 12 releasably secures the sleeve against displacement relative to the mandrel, thereby securing the ring 120 against disengagement from the profile 124.

An abutment member 130 is sealingly engaged radially between the mandrel 12 and a generally tubular lower housing 132 threadedly attached to a generally tubular intermediate housing 134, which is threadedly attached to a lower end of the wedge 62. The abutment member 130 is disposed axially between a lower end of the housing 134 and the ring 120, thereby preventing axially upward displacement of the ring relative to the housing 134. The lower housing 132 is provided with threads for attachment to a tubular string therebelow (not shown in FIG. 1F).

When it is desired to retrieve the packer 10, the sleeve 122 is shifted axially upward relative to the mandrel 12, thereby shearing the pin 126 and permitting the ring 120 to radially outwardly expand into an annular recess 136 formed internally on the sleeve. The ring 120 thus disengages from the profile 124 and permits axial displacement of the mandrel 12 relative to the substantial remainder of the packer 10. As described above, such axially upward displacement of the mandrel 12 also permits the release device 20 to axially contract. The sleeve 122 may be shifted relative to the mandrel 12 by any of a variety of conventional shifting tools (not shown) in a conventional manner.

As representatively illustrated in FIGS. 1A–1F, the packer 10 is in a configuration in which it may be run into a well and positioned within a tubular structure in the well. Specifically, both slips 28, 42 and the seal elements 70 are radially inwardly retracted.

Referring additionally now to FIGS. 2A–2F, the packer 10 is representatively illustrated set within a tubular structure (represented by inner side surface 138). The slips 28, 42 are radially outwardly extended into gripping engagement with the tubular structure 138, and the seal assembly 18 is axially compressed and radially outwardly extended into sealing engagement with the tubular structure. Note that the seal assembly 18 is shown as a single seal element 70 for clarity of illustration, and to demonstrate that alternate configurations of the seal assembly may be utilized without departing from the principles of the present invention.

To set the packer 10, a fluid pressure is applied to the interior of the mandrel 12. This fluid pressure enters the opening 88 and urges the piston 84 downward while urging the lower element retainer 76 upward. When the fluid pressure reaches a predetermined level, the shear screw 98 shears, thereby permitting the wedge 58 to displace axially downward relative to the housing 82. The wedge 58 is prevented from displacing axially upward relative to the housing 82 by the internal slip assembly 24, as described above.

Shearing of the shear screw 98 also permits the housing 82 and element retainer 76 to displace axially upward relative to the mandrel 12. The retainer 76 pushes axially upward on the seal assembly 18, axially compressing and radially outwardly extending the seal element 70. The seal assembly 18 pushes axially upward on the upper retainer 74. The upper retainer 74 is prevented from displacing axially upward relative to the wedge 32 by the ring 108, so the retainer 74 pushes axially upward on the wedge 32 via the ring 108, shearing the pin 114 and permitting axially upward displacement of the wedge relative to the mandrel 12.

Axially upward displacement of the wedge 32 causes the slip 28 to be radially outwardly displaced by cooperative engagement of the surfaces 50, 52, and by cooperative engagement of the surfaces 46, 48. The slip 28 is thus radially outwardly extended by axial displacement of the wedge 32 toward the wedge 30. As the slip 28 is radially outwardly displaced, it also displaces somewhat axially upward relative to the upper wedge 30. This axially upward displacement of the slip 28 causes the debris barrier 34 to be displaced axially upward relative to the inclined generally conical outer side surface 46.

The debris barrier 34 has a generally triangular-shaped cross-section, such that it is complementarily positionable radially between the surface 46 on which it is disposed and the tubular structure 138. In this manner, debris is prevented from falling and accumulating about the slip assembly 14 and seal assembly 18. Such accumulation of debris could possibly prevent ready retraction of the slip 28 when it is desired to retrieve the packer 10. To facilitate its radial expansion, the debris barrier 34 is formed of a suitable deformable material, such as TEFLON® or an elastomer. Of course, the debris barrier 34 may be differently shaped and may be formed of other materials without departing from the principles of the present invention. Note that the debris barrier 34 does not prevent fluid flow radially between the packer 10 and the tubular structure 138, but does close off the annular gap therebetween to debris flow.

In a similar manner to that described above for the upper slip 28, the lower slip 42 is radially outwardly displaced by axial displacement of the wedge 58 toward the wedge 62. Note that the wedge 62 and housing 134 are prevented from displacing axially upward relative to the mandrel 12 by the ring 64 and by another snap ring 140 disposed in a recess 142 formed externally on the mandrel 12.

At this point, it is instructive to examine the unique manner in which different types of forces applied to the packer 10 are distributed among the slips 28, 42. An axially downwardly directed load applied to the mandrel 12 (for example, by the tubular string attached to the upper end of the mandrel, or by the tubular string attached to the lower end of the lower housing 132) is resisted by engagement of the teeth 38 on the upper portion of the upper slip 28 with the tubular structure 138. Conversely, an axially upwardly directed load applied to the mandrel 12 is resisted by engagement of the teeth 38 on the lower portion of the lower slip 42 with the tubular structure 138.

An axially downwardly directed pressure differential applied to the seal assembly 18 is resisted by engagement of the teeth 40 on the upper portion of the lower slip 42 with the tubular structure 138. An axially upwardly directed pressure differential applied to the seal assembly 18 is resisted by engagement of the teeth 40 on the lower portion of the upper slip 28 with the tubular structure 138.

The above described distribution of forces provides unique advantages to the packer 10 in extreme service conditions. Note that the teeth 40 on the lower portion of the upper slip 28 and on the upper portion of the lower slip 42 serve to resist forces resulting from pressure differentials across the seal assembly 18. The teeth 38 on the upper portion of the upper slip 28 and on the lower portion of the lower slip 42 serve to resist forces resulting from loads transmitted to the mandrel 12. Accordingly, the different types of forces are distributed on each slip 28, 42.

Even more beneficial is the fact that, when the forces are combined, that is, when a load is applied to the mandrel 12 in the same direction as a pressure differential applied to the seal assembly 18, these forces are resisted by different ones of the slips 28, 42. For example, a downwardly directed load applied to the mandrel 12 is resisted by the upper slip 28, and a downwardly directed pressure differential applied to the seal assembly 18 is resisted by the lower slip 42. Conversely, an upwardly directed load transmitted to the mandrel 12 is resisted by the lower slip 42, and an upwardly directed pressure differential applied to the seal assembly 18 is resisted by the upper slip 28. Thus, concentrations of loading on the tubular structure 138 are avoided by distributing combined forces among the slips 28, 42, thereby reducing the possibility of damage to the tubular structure and the packer 10.

In the configuration of the packer 10 shown in FIGS. 2A–2F, a compressive force is stored in the seal assembly 18 even after the fluid pressure applied to the interior of the mandrel 12 is relieved, due to the internal slip assembly 24 preventing the wedge 58 and element retainer 76 from displacing axially toward each other. Since the slips 28, 42 are grippingly engaged with the tubular structure 138 axially straddling the seal assembly 18, this stored compressive force corresponds to a tensile force applied to the tubular structure between the slips. It will be readily appreciated that the compressive force stored in the seal assembly 18 prevents disengagement of the slips 28, 42 from the tubular structure, since the seal assembly urges upwardly on the wedge 32 via the release device 20, and urges downwardly on the wedge 58 via the retainer 76, housing 82 and internal slip assembly 24. Or, stated from a different perspective, the tensile force stored in the tubular structure between the slips 28, 42 urges the slips toward their respective wedges 32, 58.

Therefore, in order to conveniently disengage the slips 28, 42 from the tubular structure, the packer 10 includes the retrieval mechanism 26 and the release device 20. The retrieval mechanism 26, when activated, permits axially upward displacement of the mandrel 12 relative to the substantial remainder of the packer 10. The release device 20, upon axially upward displacement of the mandrel 12, releases the stored compressive force from the seal assembly 18 by permitting the seal assembly to axially elongate.

Referring additionally now to FIGS. 3A–3F, the packer 10 is representatively illustrated in a configuration in which it may be retrieved from the tubular structure 138. The sleeve 122 has been shifted upwardly, thereby permitting the ring 120 to disengage from the profile 124. The mandrel 12 has then been displaced axially upward by, for example picking up on the tubular string attached thereto.

Axially upward displacement of the mandrel 12 has permitted the ring 108 to radially inwardly retract into the recess 112, thereby permitting the element retainer 74 to axially upwardly displace relative to the seal assembly 18. As a result, the compressive force in the seal assembly 18 is released, the seal assembly is permitted to axially elongate, and the seal elements 70 are radially inwardly retracted out of engagement with the tubular structure 138 (not shown in FIGS. 3A–3F).

When the compressive force is released from the seal assembly 18, the corresponding tensile force in the tubular structure 138 between the slips 28, 42 is also released. The slips 28, 42 are thus permitted to radially inwardly retract. Note that at this point the inner wedges 32, 58 are not biased axially away from each other, and the slips 28, 42 are not biased axially toward each other.

Further axially upward displacement of the mandrel 12 causes the ring 36 to engage the wedge 30, and the ring 64 to engage the wedge 58. If the slips 28 have not already completely radially inwardly retracted due to their own resiliency, cooperative engagement of the surfaces 54, 56 will cause the slips to retract out of engagement with the tubular structure 138. Such axially upward displacement of the mandrel 12 also causes the ring 86 to engage the element retainer 76, and the ring 140 to engage the wedge 62, ensuring that the remainder of the packer 10 is retrieved.

Note that, if it is not possible to shift the sleeve 122 as described above, the mandrel 12 may still be axially upwardly displaced to retrieve the packer 10 by severing the mandrel axially between the recess 142 and the profile 124. The mandrel 12 may be severed by conventional methods, such as a linear shaped charge, a thermal cutter, or a chemical cutter, etc.

Thus has been described the packer 10 and methods of anchoring and retrieving apparatus within a tubular structure in a subterranean well. The packer 10 is uniquely configured for use in extreme service conditions, such as those in which very large combined forces may be applied to the packer, but it is also usable in other conditions. Additionally, the packer 10 has been described as incorporating, in a single embodiment, many advantageous features of the present invention. However, it is to be understood that these features may be separately incorporated into various embodiments of the present invention.

Of course, it would be obvious to a person of ordinary skill in the art to make modifications, substitutions, additions, deletions, substitutions, and other changes to the exemplary embodiment of the present invention described above, and such changes are contemplated by the principles of the present invention. For example, instead of being hydraulically settable, the packer 10 could easily be configured to be settable by manipulation of a tubular string attached thereto, and instead of being retrievable, the packer could be configured as a permanent packer. As another example, instead of axially compressing the seal elements 70, the seal elements could be radially outwardly extended by displacing a radially enlarged outer side surface of the mandrel 12 to a position underlying the seal elements. Accordingly, the foregoing detailed description is to be clearly understood as being given by way of illustration and example only, the spirit and scope of the present invention being limited solely by the appended claims.

What is claimed is:

1. Apparatus operatively positionable within a subterranean well, the apparatus comprising:

a generally tubular mandrel;

first and second dual slips disposed relative to the mandrel, the first dual slip being axially spaced apart from the second dual slip;

a circumferential seal element carried on the mandrel, the seal element being disposed axially between the first and second dual slips; and first and second generally conical wedges disposed at least partially radially between the first dual slip and the mandrel, and third and fourth generally conical wedges disposed at least partially radially between the second dual slip and the mandrel.

2. The apparatus according to claim 1, wherein the first dual slip is radially outwardly extendable relative to the mandrel by displacing the second wedge in a first axial direction relative to the mandrel, and wherein the second dual slip is radially outwardly extendable relative to the mandrel by displacing the third wedge in a second axial direction, opposite to the first axial direction, relative to the mandrel.

3. The apparatus according to claim 2, further comprising first and second annular pistons carried on the mandrel axially between the second and third wedges, each of the first and second pistons displacing one of the second and third wedges in a respective one of the first and second axial directions when fluid pressure is applied to the interior of the mandrel.

4. A packer settable within a tubular structure, the packer comprising:

a generally tubular mandrel;

first and second axially spaced apart slips disposed relative to the mandrel, the first and second slips being radially outwardly extendable into gripping engagement with the tubular structure when the packer is set therein, the first slip resisting a load applied to the mandrel in a first axial direction, and the second slip resisting another load applied to the mandrel in a second direction, opposite to the first direction;

a seal element carried about the mandrel between the first and second slips, the seal element being radially outwardly extendable into sealing engagement with the tubular structure when the packer is set therein, a pressure differential in the first axial direction applied to the seal element being resisted by the second slip, and a pressure differential in the second direction applied to the seal element being resisted by the first slip; and first and second wedge members, the first wedge member being disposed at least partially between the seal element and the first slip, and the second wedge member being disposed at least partially between the seal element and the second slip.

5. The packer according to claim 4, wherein each of the first and second slips is a dual slip.

6. The packer according to claim 4, further comprising third and fourth wedge members, the first slip being disposed at least partially between the first and third wedge members, and the second slip being disposed at least partially between the second and fourth wedge members.

7. The packer according to claim 4, wherein the first wedge member is axially telescopingly disposed relative to an element retainer disposed axially between the first wedge member and the seal element.

8. A packer, comprising:

first and second axially spaced apart slip assemblies;

a radially outwardly extendable circumferential seal element positioned axially between the first and second slip assemblies;

an axially extendable internal slip assembly configured to prevent reduction of a first axial distance between the seal element and the second slip assembly; and an axially compressible assembly configured to permit reduction of a second axial distance between the seal element and one of the first and second slip assemblies.

9. The packer according to claim 8, wherein the internal slip assembly is disposed axially between the seal element and the second slip assembly, and wherein the axially compressible assembly is disposed axially between the seal element and the first slip assembly.

10. The packer according to claim 8, wherein each of the first and second slip assemblies includes a dual slip.

11. The packer according to claim 8, wherein the axially compressible assembly includes a portion of a wedge member included in the first slip assembly, the wedge member being axially telescopingly disposed relative to an element retainer positioned axially between the seal element and the wedge member.

12. The packer according to claim 8, further comprising a generally tubular mandrel, and wherein the axially compressible assembly is releasably secured in an axially extended configuration, the axially compressible assembly being released for axial compression thereof when the mandrel is displaced a predetermined third axial distance relative to the axially compressible assembly.

13. A method of securing an apparatus within a tubular structure disposed in a subterranean well, the method comprising the steps of:

disposing first and second axially spaced apart dual slips on the apparatus;

positioning the apparatus within the tubular structure;

radially outwardly extending the first and second dual slips, each of the dual slips grippingly engaging the tubular structure;

radially outwardly extending a circumferential seal element into sealing engagement with the tubular structure, the seal element being disposed axially between the first and second dual slips;

disposing first and second wedges at least partially radially between the first dual slip and a generally tubular mandrel; and disposing third and fourth wedges at least partially radially between the second dual slip and the mandrel.

14. The method according to claim 13, wherein the step of radially outwardly extending the first and second dual slips is performed by displacing the second wedge in a first axial direction relative to the mandrel and displacing the third wedge in a second axial direction, opposite to the first axial direction, relative to the mandrel.

15. The method according to claim 14, further comprising the steps of disposing first and second annular pistons on the mandrel, and applying fluid pressure to the interior of the mandrel, thereby causing each of the first and second pistons to displace one of the second and third wedges.

16. A method of distributing forces between a packer and a tubular structure in which the packer is to be set, the method comprising the steps of:

positioning the packer in the tubular structure, the packer including a generally tubular mandrel, first and second axially spaced apart slips disposed relative to the mandrel, and a seal element carried between the first and second slips;

radially outwardly extending the first and second slips into gripping engagement with the tubular structure;

preventing displacement of he packer relative to the tubular structure by resisting a first load applied to the mandrel in a first axial direction with the first slip;

preventing displacement of the packer relative to he tubular structure by resisting a first pressure differential applied to the seal element in the first axial direction with the second slip;

applying a tensile force to the tubular structure between the first and second slips; and releasing the tensile force from the tubular structure by permitting the seal element to axially elongate between the first and second slips.

17. The method according to claim 16, further comprising the step of preventing displacement of the packer relative to the tubular structure by resisting a second load applied to the mandrel in a second axial direction, opposite to the first axial direction, with the second slip.

18. The method according to claim 17, further comprising the step of preventing displacement of the packer relative to the tubular structure by resisting a second pressure differential applied to the seal element in the second axial direction with the first slip.

19. The method according to claim 16, wherein in the positioning step, each of the first and second slips is provided as a dual slip.

20. A method of releasing a packer from gripping engagement with a tubular structure in a subterranean well, the method comprising the steps of:

grippingly engaging first and second axially spaced apart slips carried on the packer with the tubular structure, while axially compressing and radially extending a seal element carried on the packer into sealing engagement with the tubular structure, thereby applying a tensile force to the tubular structure between the slips and applying a corresponding compressive force to the seal element;

releasably retaining the compressive force in the seal element with a release device carried on the packer; and activating the release device to release the compressive force from the seal element, thereby releasing the tensile force from the tubular structure.

21. The method according to claim 20, wherein in the grippingly engaging step, each of the first and second slips is provided as a dual slip.

22. The method according to claim 20, wherein the activating step further comprises axially compressing the release device.

23. The method according to claim 20, wherein the activating step further comprises displacing a generally tubular mandrel relative to the release device.

24. The method according to claim 20, wherein the activating step further comprises axially telescopingly compressing the release device between the seal element and one of the first and second slips.

* * * * *